US007080625B2

(12) United States Patent
Albertson et al.

(10) Patent No.: US 7,080,625 B2
(45) Date of Patent: Jul. 25, 2006

(54) ENGINE OPERATION DURING CYLINDER DEACTIVATION

(75) Inventors: William C. Albertson, Clinton Township, MI (US); Alexander J. Roberts, Rochester, MI (US); Thomas E. Bolander, Flint, MI (US); Michael A. Kropinski, Troy, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/851,000

(22) Filed: May 21, 2004

(65) Prior Publication Data

US 2005/0257778 A1 Nov. 24, 2005

(51) Int. Cl.
*F02D 13/06* (2006.01)

(52) U.S. Cl. ..... 123/325; 123/198 F; 123/481

(58) Field of Classification Search ..... 123/195 A, 123/198 C, 198 F, 325, 481, 493
See application file for complete search history.

(56) References Cited

U.S. PATENT DOCUMENTS

| | | | | |
|---|---|---|---|---|
| 6,619,258 | B1 * | 9/2003 | McKay et al. | 123/198 F |
| 6,840,213 | B1 * | 1/2005 | Takahashi et al. | 123/481 |
| 6,907,871 | B1 * | 6/2005 | Fukusako et al. | 123/198 F |
| 2005/0076882 | A1 * | 4/2005 | Rayl | 123/198 F |

FOREIGN PATENT DOCUMENTS

| | | | |
|---|---|---|---|
| JP | 59-51144 | * | 3/1984 |
| JP | 60-62626 | * | 4/1985 |

* cited by examiner

*Primary Examiner*—T. M. Argenbright
(74) *Attorney, Agent, or Firm*—Christopher DeVries

(57) ABSTRACT

An engine control system for controlling engine operation in activated and deactivated modes in a displacement on demand engine system includes an engine control that generates a load control signal based on one of an activation and a deactivation signal. An accessory control manipulates operation of an accessory driven by the engine based on the load control signal.

41 Claims, 5 Drawing Sheets

ENGINE OPERATION DURING CYLINDER DEACTIVATION

FIELD OF THE INVENTION

The present invention relates to internal combustion engines, and more particularly to engine control systems that control engine operation in a displacement on demand engine.

BACKGROUND OF THE INVENTION

Some internal combustion engines include engine control systems that deactivate cylinders under low load situations. For example, an eight cylinder engine can be operated using four cylinders to improve fuel economy by reducing pumping losses. This process is generally referred to as displacement on demand or DOD. Operation using all of the engine cylinders is referred to as an activated mode. A deactivated mode refers to operation using less than all of the cylinders of the engine (one or more cylinders not active).

In the deactivated mode, there are less cylinders operating. As a result, there is less drive torque available to drive the vehicle driveline and accessories (e.g., alternator, coolant pump, A/C compressor). Engine efficiency, however, is increased as a result of decreased fuel consumption (i.e., no fuel supplied to the deactivated cylinders) and decreased engine pumping. Because the deactivated cylinders do not take in and compress fresh intake air, pumping losses are reduced.

A disadvantage of engine operation in the deactivated mode appears during deceleration. When decelerating with the engine operating in the activated mode, engine pumping assists vehicle deceleration. However, because engine pumping is decreased during the deactivated mode, there is less engine pumping to assist deceleration. As a result, an operator experiences a sail-on feel and must use increased braking force to decelerate the vehicle during engine operation in the deactivated mode.

SUMMARY OF THE INVENTION

Accordingly, the present invention provides an engine control system for controlling engine operation in activated and deactivated modes in a displacement on demand engine. The engine control system includes an engine control that generates a load control signal based on one of an activation and a deactivation signal and an accessory control that manipulates operation of an accessory driven by the engine based on the load control signal.

In one feature, the engine control system further includes a look-up table that generates the activation or the deactivation signal based on a manifold absolute pressure (MAP) signal and an engine speed (RPM) signal.

In another feature, the engine control system further includes a cylinder actuator that manipulates operation of cylinders of the engine based on the activation or deactivation signal. The cylinder actuator manipulates operation of the cylinders based on a cylinder control signal generated by the engine control.

In another feature, the accessory control adjusts an alternator charging duty cycle based on the load control signal.

In still another feature, the accessory control adjusts a pump displacement based on the load control signal.

In still another feature, the engine control system further includes a vehicle speed monitor that generates a deceleration signal. The load control signal is further based on the deceleration signal.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
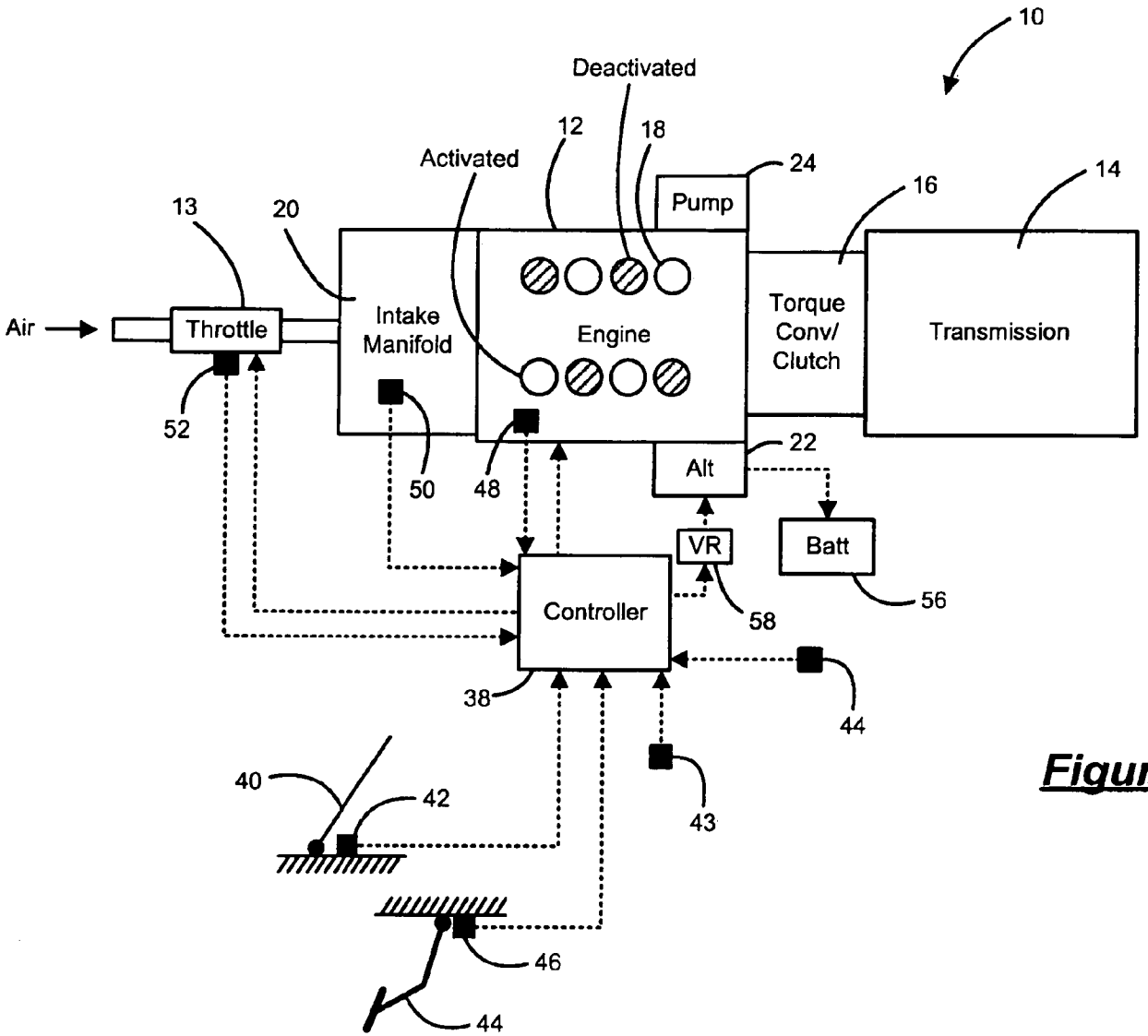
FIG. 1 is a functional block diagram illustrating a vehicle powertrain including a displacement on demand (DOD) engine control system according to the present invention.

The following description of the preferred embodiment is merely exemplary in nature and is in no way intended to limit the invention, its application, or uses. For purposes of clarity, the same reference numbers will be used in the drawings to identify similar elements. As used herein, activated refers to operation using all of the engine cylinders. Deactivated refers to operation using less than all of the cylinders of the engine (one or more cylinders not active).

Figure 2:
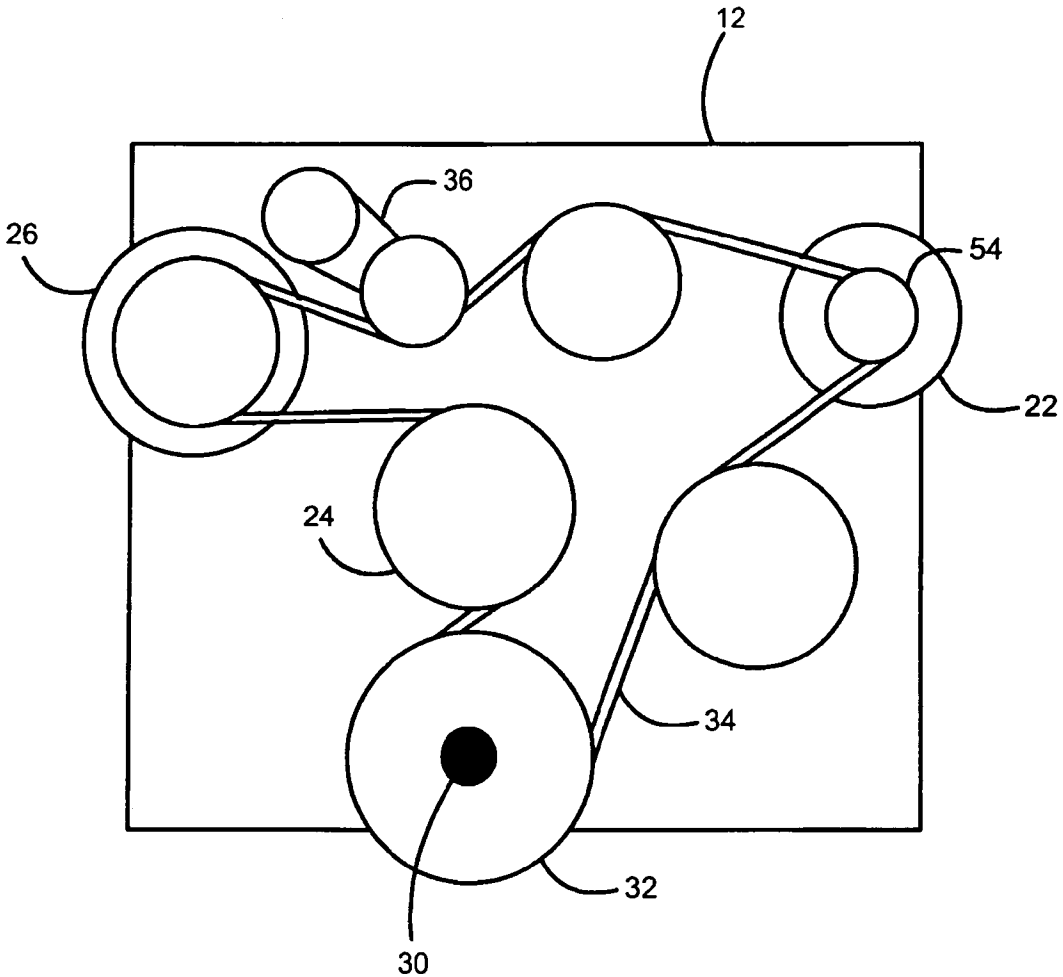
FIG. 2 is a schematic front view of an engine of a vehicle powertrain.

Referring now to FIGS. 1 and 2, a vehicle 10 includes an engine 12 that drives a transmission 14. The transmission 14 is either an automatic or a manual transmission that is driven by the engine 12 through a corresponding torque converter or clutch 16. Air flows into the engine 12 through a throttle 13. The engine 12 includes N cylinders 18. One or more of the cylinders 18 are selectively deactivated during engine operation. Although FIG. 1 depicts eight cylinders (N=8), it is appreciated that the engine 12 may include additional or fewer cylinders 18. For example, engines having 4, 5, 6, 8, 10, 12 and 16 cylinders are contemplated. Air flows into the engine 12 through an intake manifold 20 and is combusted with fuel in the cylinders 18.

The engine 12 also drives accessory loads including an alternator 22, a coolant pump 24, a compressor 26 and a power steering pump 28. More particularly, the engine 12 includes a rotatably driven crankshaft 30 and crankshaft pulley 32 that drives a belt drive 34. The belt drive 34 drives the other accessory loads, as discussed in further detail below. A tensioner 36 is also provided to regulate the tension of the belt drive 34.

A controller 38 communicates with the engine 12 and various inputs and sensors as discussed herein. A vehicle operator manipulates an accelerator pedal 40 to regulate the throttle 13. More particularly, a pedal position sensor 42 generates a pedal position signal that is communicated to the controller 38. The controller 38 generates a throttle control signal based on the pedal position signal. A throttle actuator (not shown) adjusts the throttle 13 based on the throttle control signal to regulate air flow into the engine 12. The vehicle operator manipulates a brake pedal 44 to regulate vehicle braking. More particularly, a brake position sensor 46 generates a brake pedal position signal that is communicated to the controller 38. The controller 38 generates a brake control signal based on the brake pedal position signal. A brake system (not shown) adjusts vehicle braking based on the brake control signal to regulate vehicle speed. An engine speed sensor 48 generates a signal based on engine speed. An intake manifold absolute pressure (MAP) sensor 50 generates a signal based on a pressure of the intake manifold 20. A throttle position sensor (TPS) 52 generates a signal based on throttle position.

The belt drive 34 engages and rotates an alternator pulley 54, which drives the alternator 22. The alternator 22 generates power to recharge a battery 56. A voltage regulator 58 adjusts a charging duty cycle of the alternator 22 based on signals from the controller 38. It is appreciated that the voltage regulator 58 can be an integrated component of the alternator 22. When a voltage of the battery 56 is below a desired operating voltage (e.g., 14.4V), the controller 38 signals the voltage regulator 58 to operate the alternator 22 at a specified charging duty cycle to produce charging current. When a voltage of the battery 56 is above the desired operating voltage, the controller 38 signals the voltage regulator 58 to cease alternator operation. In this manner, the charging duty cycle of the alternator 22 is adjustable. The controller 38 varies the charging duty cycle according to the DOD engine control, as explained in further detail below.

Similarly, the belt drive 34 engages and rotates the coolant pump 24. The coolant pump 24 pumps coolant through a coolant system (not shown) to regulate a temperature of the engine 12. The coolant pump 24 is a variable displacement type pump such as, but not limited to, a variable vane type variable displacement pump. The coolant pump 24 is selectively adjustable to vary the amount of fluid pumped therethrough. As the displacement of the coolant pump 24 varies, the load on the engine 12 correspondingly varies. More specifically, as the displacement increases, the load on the engine 12 also increases. The controller 38 varies the coolant pump displacement according to the DOD engine control, as explained in further detail below.

When light engine load occurs, the controller 38 transitions the engine 12 to the deactivated mode. In an exemplary embodiment, N/2 cylinders 18 are deactivated, although one or more cylinders may be deactivated. Upon deactivation of the selected cylinders 18, the controller 38 increases the power output of the remaining or activated cylinders 18. The inlet and exhaust ports (not shown) of the deactivated cylinders 18 are closed to reduce pumping losses.

The engine load is determined based on the intake MAP, cylinder mode and engine speed. More particularly, if the MAP is below a threshold level for a given RPM, the engine load is deemed light and the engine 12 is operated in the deactivated mode. If the MAP is above the threshold level for the given RPM, the engine load is deemed heavy and the engine 12 is operated in the activated mode. The controller 38 controls the engine 12 based on the DOD engine control to reduce engine load during the deactivated mode and control the sail-on feel during deceleration in the deactivated mode.

When operating in the deactivated mode, a driver can remain at speed (e.g., cruising), accelerate or decelerate. To further improve fuel economy, the DOD engine control of the present invention decreases the coolant pump displacement and the alternator charging duty cycle during cruising or acceleration in the deactivated mode. In this manner, the engine load is decreased, requiring less power output from the engine 12.

During deceleration in the deactivated mode, however, the engine load is increased and the cylinder operation adjusted to enable heavier engine braking, thereby reducing the sail-on feel. More particularly, the DOD engine control increases the coolant pump displacement, increases the alternator charging duty cycle to increase the engine load and/or adjusts cylinder operation to increase engine pumping. For example, fuel can be cut-off to the activated cylinders. As a result, engine pumping increases because the activated cylinders process air without combustion. Alternatively, fuel is cut-off to the activated cylinders 18 and operation of the inlet and exhaust ports of the deactivated cylinders 18 can be enabled to increase engine pumping. In this manner, both the activated cylinders 18 and deactivated cylinders 18 intake and compress air without combustion. It is anticipated that the DOD engine control can implement any one, multiple or all of these methods for manipulating engine load and pumping.

It is also anticipated that the DOD engine control can control engine load and/or pumping based on the rate of deceleration in the deactivated mode. More particularly, the DOD engine control determines the rate of deceleration based on a vehicle speed signal. The DOD engine control compares the deceleration rate to a threshold deceleration. If the deceleration rate is below the threshold deceleration, the DOD engine control implements one or more of the above-described methods to increase engine breaking during deceleration. If the deceleration rate is above the threshold deceleration, the DOD engine control maximizes engine braking by implementing a combination of or all of the above-described methods Referring now to FIG. 3, an exemplary DOD engine control according to the present invention will be discussed in detail. In step 100, control determines whether to transition into the deactivated mode. If control determines not to transition into the deactivated mode, control loops back. If control determines to transition into the deactivated mode, control deactivates the cylinders in step 102. In step 104, control decreases the coolant pump displacement to reduce the engine load. In step 106, control decreases the alternator charging duty cycle to further reduce the engine load.

It is appreciated that the amount of decrease in coolant pump displacement and alternator charging duty cycle may be respectively limited based on thermal management and electrical load requirements. For example, in some instances the coolant pump displacement may only be reduced by a small amount or not at all if the reduced coolant flow would be insufficient to maintain engine operating temperature. Similarly, there may be instances where the alternator charging duty cycle may only be reduced by a small amount or not at all if the reduced alternator charging duty cycle would be insufficient to maintain the electrical load requirements.

In step 108, control determines whether the vehicle is decelerating. If the vehicle is decelerating, control continues in step 110. If the vehicle is not decelerating, control continues in step 112. In step 110, control increases the coolant pump displacement to increase the engine load. In step 114, control increases the alternator charging duty cycle to further increase the engine load. In step 116, control determines whether the vehicle deceleration exceeds the deceleration threshold. If the vehicle deceleration exceeds the deceleration threshold, control adjusts cylinder operation in step 118 to increase engine pumping. If the vehicle deceleration does not exceed the deceleration threshold, control continues in step 120.

In step 120, control determines whether vehicle deceleration is complete (i.e., vehicle is stopped, cruising or accelerating). If vehicle deceleration is complete, control continues in step 122. If vehicle deceleration is not complete, control loops back to step 116. In step 122, control adjusts cylinder operation for normal engine operation in the deactivated mode (i.e., fuel to activated cylinders, operate intake and exhaust ports of deactivated cylinders to increase pumping losses). After adjusting cylinder operation in step 122, control loops back to step 104.

In step 112, control determines whether to transition to the activated mode. If control decides not to transition to the activated mode, control loops back to step 108. If control decides to transition to the activated mode, control continues in step 124. In step 124, control activates all of the cylinders 18 and control ends.

It is appreciated that the order of the three methods for increasing engine braking is merely exemplary. The DOD engine control of the present invention can implement these methods individually or in a combined manner. More specifically, the DOD engine control can adjust cylinder operation upon deceleration and increase one or both the coolant pump displacement and the alternator charging duty cycle if the deceleration rate exceeds the deceleration threshold. Alternatively, the DOD engine control can adjust cylinder operation and increase one of the coolant pump displacement and the alternator charging duty cycle upon deceleration and increase the other of the coolant pump displacement and the alternator charging duty cycle if the deceleration rate exceeds the deceleration threshold.

Figure 5:
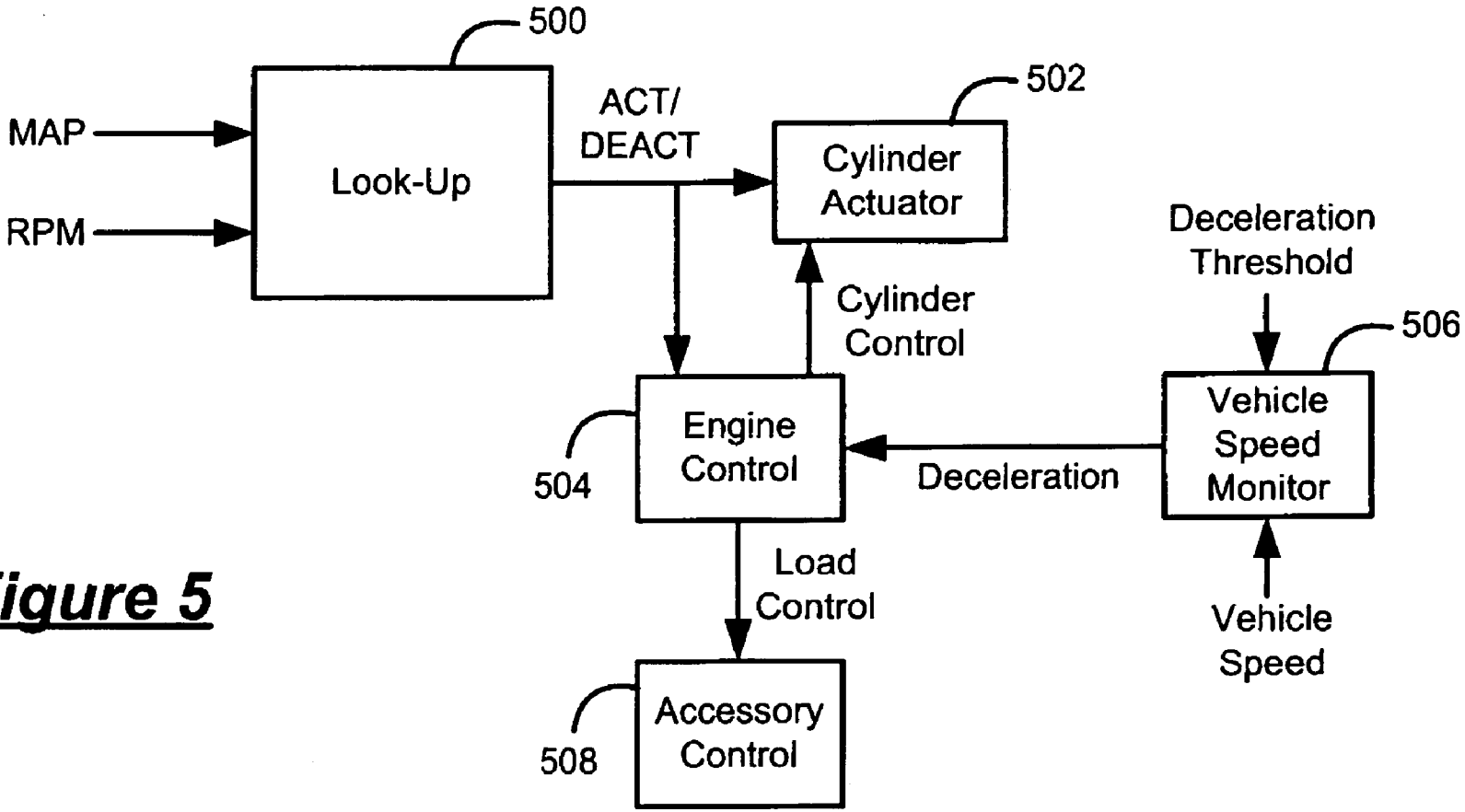
FIG. 5 is a logic diagram illustrating the DOD engine control of the present invention.

Referring now to FIG. 5, the logic flow of the DOD engine control will be described in detail. A look-up 500 receives MAP and RPM signals and generates a cylinder activation or deactivation signal based thereon. The cylinder activation or deactivation signal is sent to a cylinder actuator 502 and an engine control 504. The cylinder actuator 503 deactivates or activates selected cylinders based on the activation or deactivation signal. A vehicle speed monitor 506 generates a deceleration signal based on a vehicle speed signal and a deceleration threshold.

The engine control 504 generates cylinder control and load control signals based on the activation or deactivation signal and the deceleration signal. The load control signal is sent to an accessory control 508, which manipulates operation of the alternator 22 and the pump 24. The cylinder control signal is sent to the cylinder actuator to manipulate operation of the cylinders 18. More particularly, upon initial transition into the deactivated mode, the engine control 504 signals the accessory control 508 to decrease the engine load. If the deceleration signal indicates a particular deceleration rate while in the deactivated mode, the engine control 504 signals the accessory control to increase the engine load. Similarly, if the deceleration signal indicates an increased deceleration rate (e.g., above the deceleration threshold), the engine control 504 signals the cylinder actuator 502 to manipulate cylinder operation to increase engine pumping.

If the look-up 500 generates the activation signal, the cylinder actuator activates all of the cylinders 18. Additionally, the engine control 504 signals the accessory control 508 to operate the accessories to provide a normal engine load.

Figure 3:
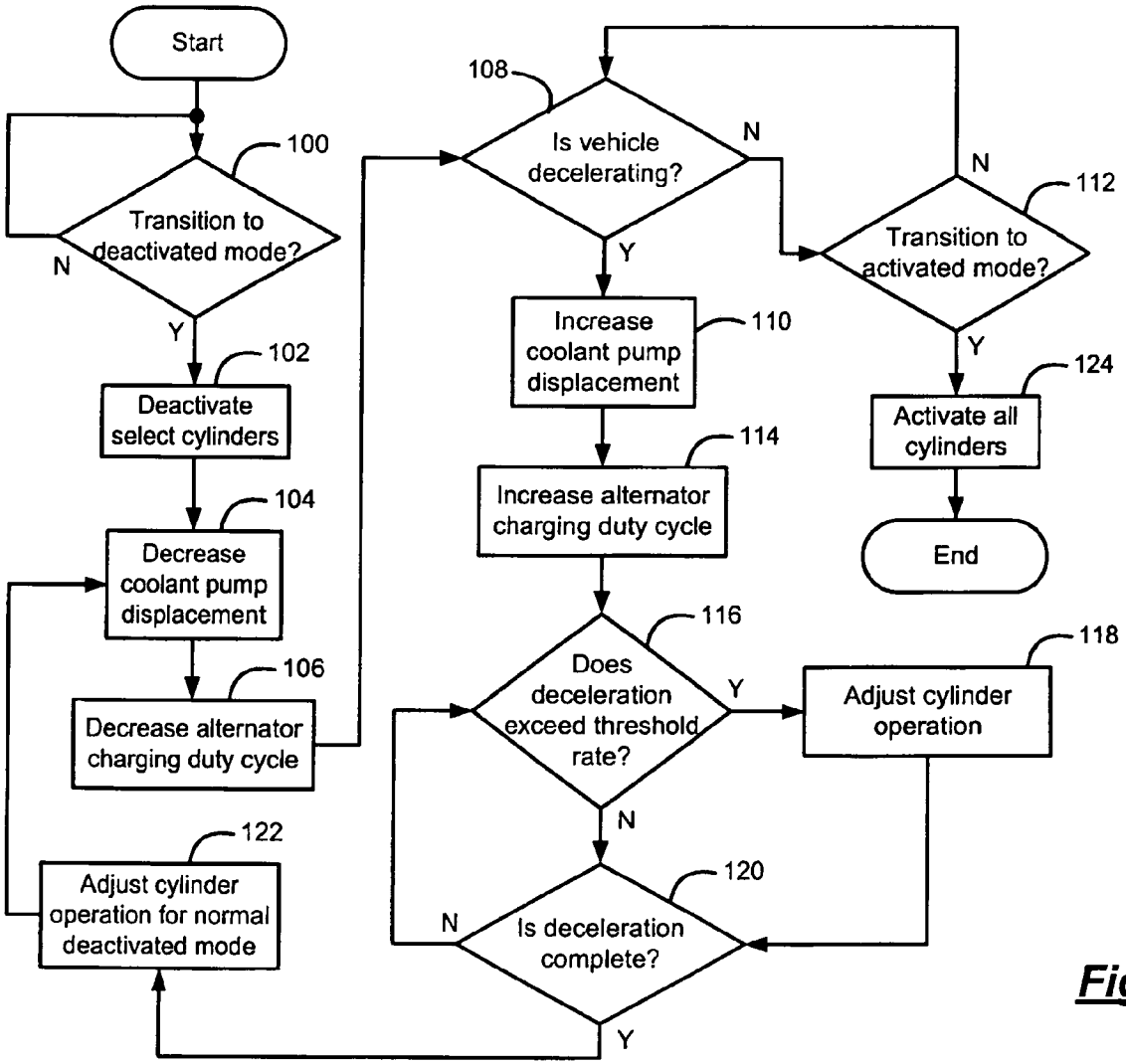
FIG. 3 is a flowchart illustrating steps performed by the DOD engine control system according to the present invention.
Figure 4:
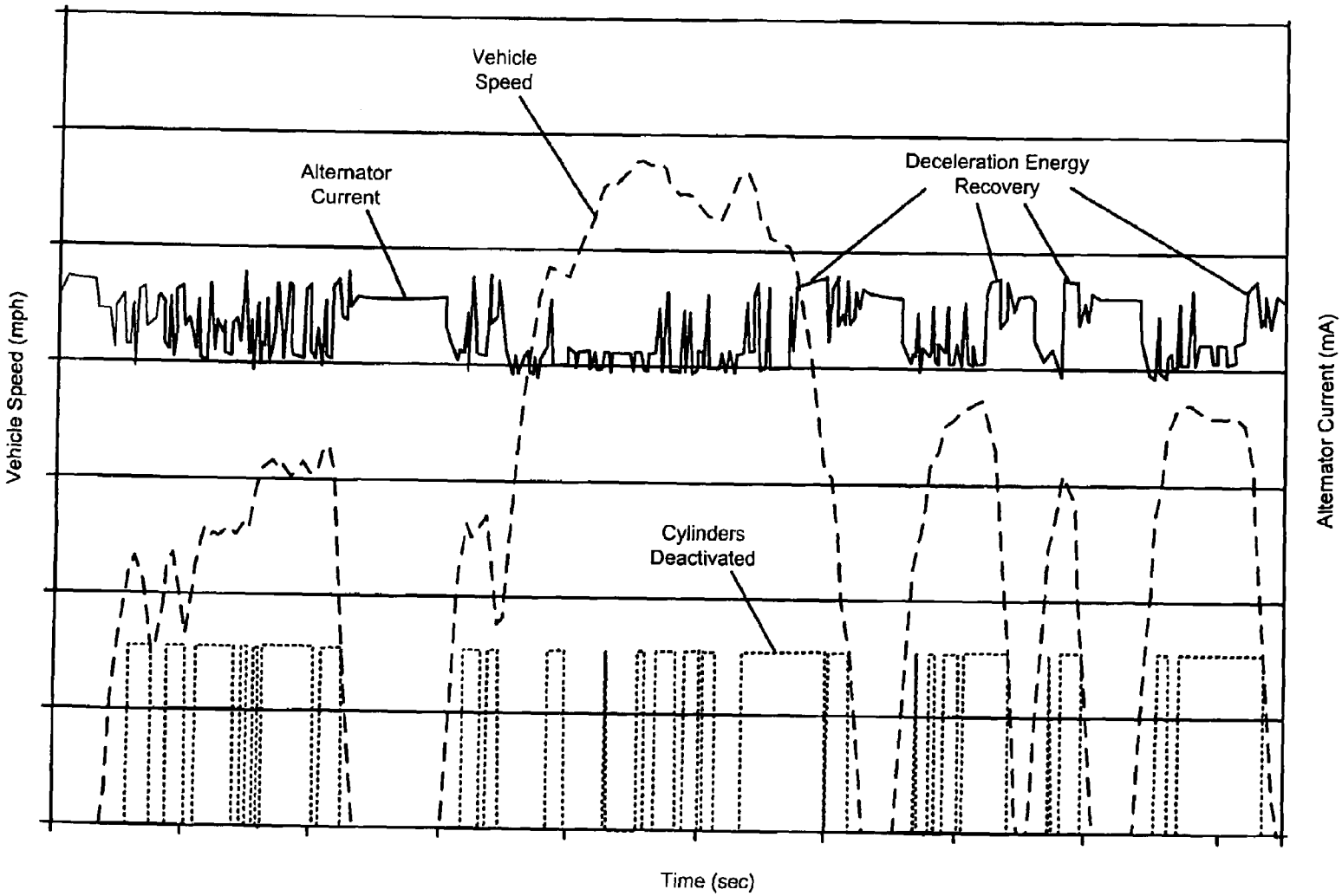
FIG. 4 is a graph illustrating an exemplary alternator current as a function of vehicle speed during the DOD engine control of the present invention.

As discussed in detail above, the DOD engine control of the present invention implements various methods for manipulating engine load in the deactivated mode. These methods include adjusting alternator charging duty cycle, adjusting pump displacement and adjusting cylinder operation to effect engine pumping. It is appreciated that the DOD engine control described with reference to FIGS. 3 and 5 is merely exemplary in nature. More particularly, it is anticipated that the DOD engine control of the present invention can implement each of these methods alone or in combination to effect engine load.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. An engine control system for controlling engine operation in activated and deactivated modes in a displacement on demand engine, comprising:

an engine control that generates a load control signal based on one of an activation and a deactivation signal;

a vehicle speed monitor that generates a deceleration signal, wherein said load control signal is further based on said deceleration signal; and an accessory control that manipulates operation of an accessory driven by said engine based on said load control signal.

2. The engine control system of claim 1 further comprising a look-up table that generates said one of an activation and a deactivation signal based on a manifold absolute pressure (MAP) signal and an engine speed (RPM) signal.

3. The engine control system of claim 1 further comprising a cylinder actuator that manipulates operation of cylinders of said engine based on said one of an activation and deactivation signal.

4. The engine control system of claim 3 wherein said cylinder actuator manipulates operation of said cylinders based on a cylinder control signal generated by said engine control.

5. The engine control signal of claim 1 wherein said accessory control adjusts an alternator charging duty cycle based on said load control signal.

6. The engine control system of claim 1 wherein said accessory control adjusts a pump displacement based on said load control signal.

7. An engine control system for controlling engine operation in activated and deactivated modes in a displacement on demand engine, comprising:

an alternator that is driven by said engine and that has an adjustable duty cycle; and a controller that transitions said engine between said activated mode and said deactivated mode, that monitors a velocity of a vehicle driven by said engine and that increases said duty cycle of said alternator when said vehicle decelerates during said deactivated mode.

8. The engine control system of claim 7 further comprising a variable displacement pump that is driven by said engine, wherein said controller increases a displacement of said pump when said vehicle decelerates during said deactivated mode.

9. The engine control system of claim 7 wherein said controller terminates fuel supply to activated cylinders of said engine when said vehicle decelerates during said deactivated mode.

10. The engine control system of claim 9 wherein said controller activates intake and exhaust valves associated with deactivated cylinders of said engine to enable air processing within said deactivated cylinders when said vehicle decelerates during said deactivated mode.

11. The engine control system of claim 7 wherein said controller reduces said duty cycle of said alternator when said vehicle is one of cruising and accelerating when said engine is operating in said deactivated mode.

12. The engine control system of claim 7 wherein said controller reduces said displacement of said pump when said vehicle is one of cruising and accelerating when said engine is operating in said deactivated mode.

13. A method for controlling engine operation during activated and deactivated modes in a displacement on demand engine, comprising:

detecting deceleration of a vehicle driven by said engine; and increasing a duty cycle of an alternator driven by said engine when said vehicle decelerates during operation of said engine during said deactivated mode.

14. The method of claim 13 further comprising increasing a displacement of a pump driven by said engine when said vehicle decelerates during operation of said engine in said deactivated mode.

15. The method of claim 13 further comprising terminating fuel supply to activated cylinders of said engine when said vehicle decelerates during said deactivated mode.

16. The method of claim 15 further comprising activating intake and exhaust valves associated with deactivated cylinders of said engine to enable air processing within said deactivated cylinders when said vehicle decelerates during said deactivated mode.

17. The method of claim 13 further comprising reducing said duty cycle of said alternator when said vehicle is one of cruising and accelerating when said engine is operating in said deactivated mode.

18. The method of claim 13 further comprising reducing said displacement of said pump when said vehicle is one of cruising and accelerating when said engine is operating in said deactivated mode.

19. An engine control system for controlling engine operation in activated and deactivated modes in a displacement on demand engine, comprising:

a pump that is driven by said engine and that has an adjustable displacement; and a controller that transitions said engine between said activated mode and said deactivated mode and that decreases a displacement of said pump when said engine transitions from said activated mode to said deactivated mode.

20. The engine control system of claim 19 wherein said controller monitors a velocity of a vehicle driven by said engine and increases said displacement of said pump when said vehicle decelerates during said deactivated mode.

21. The engine control system of claim 19 further comprising an alternator that is driven by said engine, wherein said controller increases a duty cycle of said alternator when said vehicle decelerates during said deactivated mode.

22. The engine control system of claim 19 wherein said controller decreases said duty cycle when said engine transitions from said activated mode to said deactivated mode.

23. The engine control system of claim 19 wherein said controller terminates fuel supply to activated cylinders of said engine when said vehicle decelerates during said deactivated mode.

24. The engine control system of claim 23 wherein said controller activates intake and exhaust valves associated with deactivated cylinders of said engine to enable air processing within said deactivated cylinders when said vehicle decelerates during said deactivated mode.

25. A method for controlling engine operation during activated and deactivated modes in a displacement on demand engine, comprising:

transitioning said engine from said activated mode to said deactivated mode; and reducing a displacement of a pump driven by said engine.

26. The method of claim 25 further comprising reducing a duty cycle of an alternator driven by said engine.

27. The method of claim 25 further comprising detecting deceleration of a vehicle driven by said engine.

28. The method of claim 27 further comprising increasing said displacement when said vehicle decelerates during operation of said engine in said deactivated mode.

29. The method of claim 27 further comprising increasing a duty cycle of an alternator driven by said engine when said vehicle decelerates during operation of said engine during said deactivated mode.

30. The method of claim 27 further comprising terminating fuel supply to activated cylinders of said engine when said vehicle decelerates during said deactivated mode.

31. The method of claim 30 further comprising activating intake and exhaust valves associated with deactivated cylinders of said engine to enable air processing within said deactivated cylinders when said vehicle decelerates during said deactivated mode.

32. An engine control system for controlling engine operation in activated and deactivated modes in a displacement on demand engine, comprising:

cylinders that are selectively activated and deactivated;

a controller that transitions said engine between said activated mode and said deactivated mode, that monitors a velocity of a vehicle driven by said engine and that terminates fuel supply to activated cylinders of said engine when said vehicle decelerates during said deactivated mode; and an alternator that is driven by said engine and that has an adjustable duty cycle, wherein said controller increases said duty cycle of said alternator when said vehicle decelerates during said deactivated mode.

33. The engine control system of claim 32 wherein said controller activates intake and exhaust valves associated with deactivated cylinders of said engine to enable air processing within said deactivated cylinders when said vehicle decelerates during said deactivated mode.

34. The engine control system of claim 32 wherein said controller reduces a duty cycle of said alternator driven by said engine when said engine transitions from said activated mode to said deactivated mode.

35. The engine control system of claim 32 further comprising a variable displacement pump that is driven by said engine, wherein said controller increases a displacement of said pump when said vehicle decelerates during said deactivated mode.

36. The engine control system of claim 32 wherein said controller reduces a displacement of a variable displacement pump driven by said engine when said engine transitions from said activated mode to said deactivated mode.

37. A method for controlling engine operation during activated and deactivated modes in a displacement on demand engine, comprising:

detecting deceleration of a vehicle driven by said engine;

terminating fuel supply to activated cylinders of said engine when said vehicle decelerates during said deactivated mode; and increasing a duty cycle of an alternator driven by said engine when said vehicle decelerates during operation of said engine during said deactivated mode.

38. The method of claim 37 further comprising activating intake and exhaust valves associated with deactivated cylinders of said engine to enable air processing within said deactivated cylinders when said vehicle decelerates during said deactivated mode.

39. The method of claim 37 further comprising reducing a duty cycle of said alternator driven by said engine when said engine transitions from said activated mode to said deactivated mode.

40. The method of claim 37 further comprising increasing a displacement of a pump driven by said engine when said vehicle decelerates during operation of said engine in said deactivated mode.

41. The method of claim 37 further comprising reducing a displacement of a pump driven by said engine when said engine transitions from said activated mode to said deactivated mode.

* * * * *